United States Patent [19]

Smith, Jr.

[11] 4,178,155

[45] Dec. 11, 1979

[54] PIPELINE BLOW DOWN TECHNIQUE

[76] Inventor: Bernie B. Smith, Jr., P.O. Box 10251, Corpus Christi, Tex. 78410

[21] Appl. No.: 868,218

[22] Filed: Jan. 9, 1978

[51] Int. Cl.[2] ..... F17D 3/00

[52] U.S. Cl. ..... 48/191; 48/192; 138/97; 431/202

[58] Field of Search ..... 48/191, 190, 192, 193, 48/194; 137/883; 138/97; 431/202

[56] References Cited

U.S. PATENT DOCUMENTS

| | | | |
|---|---|---|---|
| 312,470 | 2/1885 | McTighe et al. | 48/191 |
| 910,221 | 1/1909 | Niemann | 48/192 |
| 1,726,940 | 9/1929 | Anderson | 48/192 |

*Primary Examiner*—Richard V. Fisher
*Assistant Examiner*—George C. Yeung

[57] ABSTRACT

There is disclosed an installation and process for "blowing down" a pipeline containing either a high pressure flammable gas or a high pressure flammable liquid which vaporizes upon the reduction of pressure. The installation includes a pipe section for connection to the pipeline, a throttling valve for creating a pressure drop downstream thereof, and a manifold delivering throttled gas to a plurality of flare units for burning the gas from the pipeline.

10 Claims, 3 Drawing Figures

PIPELINE BLOW DOWN TECHNIQUE

Pipelines are commonly used to transport high pressure flammable gases or high pressure flammable liquids which vaporize on the reduction of pressure. Pipelines can be quite long and extend cross-country or can be quite short within the vicinity or confines of a plant or refinery. It occasionally occurs that the high pressure gas or liquid needs to be removed from the pipeline in order to repair the pipeline, install equipment in the pipeline and the like. If the pipeline contains a high pressure liquid that does not vaporize upon the reduction of pressure, the pipeline contents can normally be hauled off by truck without difficulty. If the pipeline contains a high pressure gas or a vaporizable high pressure liquid, the process of removing such gases or liquids is known in the art as "blowing down" the pipeline.

Pipelines, either of the cross-country type or shorter pipelines in the vicinity of a plant or refinery, are normally provided with a number of serially disposed block valves which control or prevent fluid flow in the pipeline. Normally provided on opposite sides of a block valve is a blow down valve which has the inlet thereof communicating with the interior of the pipeline and an outlet open to the atmosphere.

At one time, one merely closed the appropriate block valves and opened the blow down valve to allow the high pressure gas or vaporizable liquid to exhaust to the atmosphere. The technique is no longer environmentally acceptable. It never was a very wise practice with heavier hydrocarbon gases, such as ethylene, propane and the like, which are more dense than air and will hug the ground even with a moderate wind blowing and accordingly can be a substantial fire or suffocation hazard.

The next approach tried by the art was to acquire a few joints of tubing or line pipe, some fittings and a few wooden sills and lay a short pipeline from the blow down valve. Several of the sills were placed under the end of the short pipeline, the blow down valve was cracked open and the gas was lit as it came out of the short pipeline. This technique has a number of disadvantages. First, throttling the gas through the short pipeline with the blow down valve sometimes causes the valve element to erode so that the valve cannot reclose. Unfortunately, one does not learn this until the blown down pipeline sections is repressurized and the blow down valve leaks. Second, when the pressure differential across the blow down valve is large, the temperature drop across the valve is also large thereby chilling the short pipeline to such an extent that the tubing or line pipe crystallizes and loses its strength. Accordingly, while one is blowing down the large pipeline, the short pipeline begins leaking or the short pipeline is ruined during the blow down operation. It is often not detected that the short pipeline is ruined because failure of the short pipeline is not apparent unless it leaks badly. If the short pipeline is disassembled and later used elsewhere, it will fail badly for no apparent reason. Third, many of the cross-country pipeline sections that need to be blown down are remotely located so that the persons conducting the operation must acquire the appropriate fittings to connect to the blow down valve. Invariably, it is discovered that some connection is missing thereby causing a considerable delay.

In accordance with this invention, there is provided a towable trailer having thereon a multiplicity of disassembled elements, such as pipe sections, flare units and fittings. The components carried on the trailer include fittings and connections suitable for attachment to a wide variety of blow down valves.

When assembled, the blow down installation of this invention includes a very short pipe section connected to the blow down valve and having a flow controlling valve at the end thereof. An arcuate pipe section connects to the valve and accommodates thermal expansion and contraction of the pipe downstream thereof. Almost immediately after the arcuate pipe section is a heater delivering heated gas or vaporizable liquid to a throttling valve that is used to control the downstream pressure. A number of pipe joints which are conveniently connected by unions extend downstream from the throttling valve to a manifold. Extending from the manifold are a plurality of relatively short pipe sections having a valve therein which are connected to a plurality of flare units.

It will accordingly be apparent that one object of this invention is to provide a convenient apparatus and technique for blowing down a pipe line containing a high pressure flammable gas or a high pressure flammable liquid which vaporizes on the reduction of pressure.

In the drawings

Figure 1:
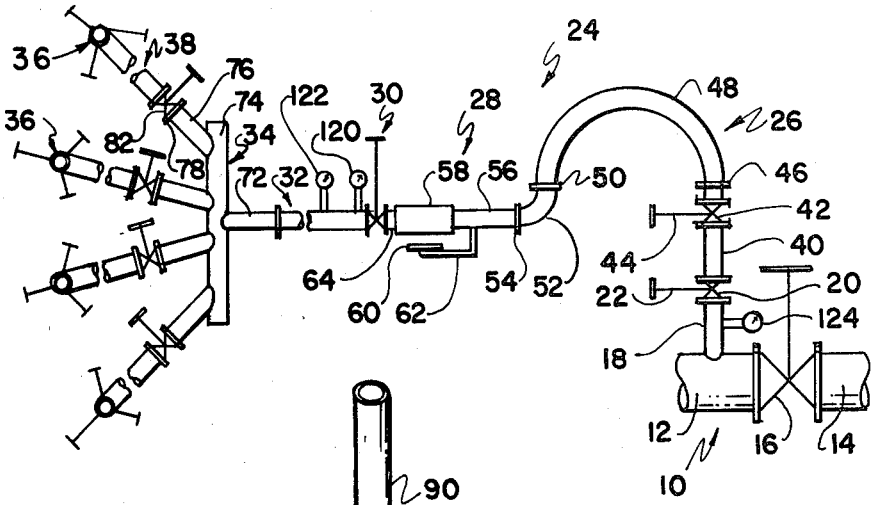
FIG. 1 is a schematic view of an assembled blow down installation of this invention.

Referring to FIG. 1, there is illustrated a pipeline 10 comprising a pair of pipeline sections 12, 14 separated by a block valve 16. Although the block valve 16 may be buried below ground level, in cross-country pipelines the block valve 16 is above ground level. Accordingly, the pipeline sections 12, 14 typically comprise a short generally horizontal length above ground, a 45° elbow, a short inclined section which extends from above ground level to below ground level, and another 45° elbow connected with the long pipeline section that is underground. Adjacent the block valve 16 is a stub conduit 18 communicating with the pipeline section 12 and having a blow down valve 20 provided with a handle 22 mounted on the top of the stub conduit 18. Typically, a similar stub conduit and blow down valve (not shown) are provided on the other side of the valve 16 for blowing down the pipeline section 14. Those skilled in the art will recognize the pipeline 10, as heretofore described, as being typical of cross-country pipelines.

Connected to the blow down valve 20 is a blow down installation 24 of this invention comprising, as major components, a thermal expansion and contraction loop 26, a heater 28, a throttling valve 30, a plurality of short pipeline sections 32, a manifold 34 and a plurality of flare units 36 connected by short pipe sections 38 to the manifold 34.

The thermal expansion and contraction loop 26 is connected to the blow down valve 20 by a stub conduit 40 which has a connection at one end thereof compatible with the end fittings of the blow down valve 20 and has a fitting at the other end thereof, conveniently a union, for attachment to a flow controlling valve 42 having an operating handle 44 thereon. Unions are, of course, well known in the art and are used to provide a technique for quickly coupling pipe components together. One typical type union is described in the Composite Catalog of Oil Field Equipment and Services, p. 600, 1974–75 Edition. The valve 42 is provided with a union 46 which connects to the loop 26. As will be more fully pointed out hereinafter, the valve 42 is used to control fluid flow through the blow down installation 24 rather than using the blow down valve 20 in order to avoid eroding of the valve element thereof.

The thermal contraction and expansion loop 26 comprises an arcuate pipe segment 48 which may be partially circular as illustrated or a complete loop. The pipe segment 48 may be disposed either horizontally on the ground or extending upwardly into the air. The pipe segment 48 terminates in a union 50 which connects to an ell 52 having a union 54 on the end thereof connected to an inlet conduit 56 of the heater 28.

The heater 28 may be of any suitable type such as is customarily used in the oil field for heating well streams. A supplier of suitable direct heaters of this type is BS&B Process System, Inc. of Houston, Texas. Broadly, heaters of this type incorporate a vessel 58 through which the material passes in heat exchange relation with the flame of a burner 60 supplied with fuel through a line 62 connected to the inlet conduit 56 or connected to the outlet conduit. Accordingly, the heater 28 is of the type that uses part of the stream to be heated as a heat source of fuel for the remaining portion of the stream. The heater 28 terminates in an outlet conduit 64 connected to the throttling valve 30. As will be more fully pointed out hereinafter, the heater 28 is used when the pressure across the throttling valve 30 is so great as to lower the temperature downstream thereof below a value which can be accommodated by the short pipeline sections 32 without damaging them.

Although the throttling valve 30 and pipeline sections 32 may be of any suitable type, it is preferred that it be of a material which is not metallurgically affected by operation in low temperature environments. As will be more fully explained hereinafter, techniques are available for controlling the pressure drop across the throttling valve 30 and consequently controlling the temperature downstream thereof. For operating temperatures down to about −41° F., typical oil field grade valves and pipeline sections 32 can be employed. At lower temperatures, other types of material are required for the valve 30 and all components downstream thereof in order to prevent damage during low temperature operation. Stainless steel has been found to be suitable material for the throttling valve 30 and pipeline sections 32 at operating temperatures down to about −76° F. The mechanical design of the throttling valve 30 may be of any suitable type so long as the valve acts to progressively open and thereby to progressively increase the size of a flow constriction therethrough.

Figure 3:
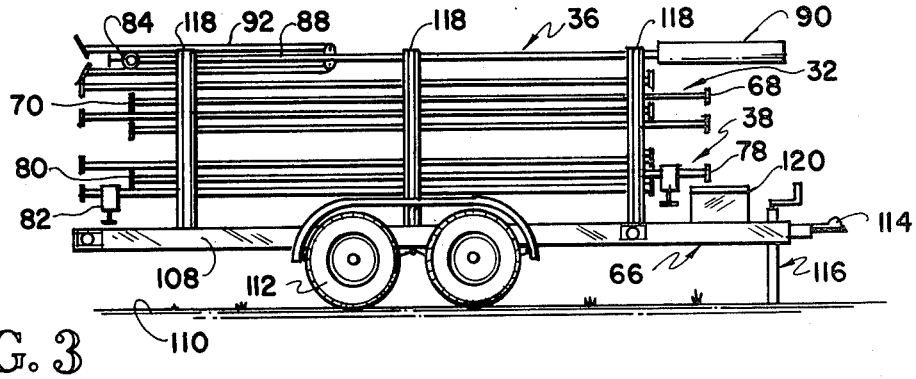
FIG. 3 is a side elevational view of a trailer mounted unit incorporating the components of the installation of FIG. 1.

The short pipeline sections 32 are desirably of a length that can be carried on the trailer 66 illustrated in FIG. 3 and are equipped with male and female union connections 68, 70 so that a plurality of the sections 32 can be quickly and expeditiously joined together. As mentioned previously, the sections 32 may be of oil field grade, for example J-55 tubing or line pipe, for operations down to about −41° F. but are preferably of stainless steel to allow operations at lower temperatures.

The manifold 34 comprises a single inlet 72, a header 74 and a multiplicity of divergent outlets 76. The outlets 76 provide sufficient room for the flare units 36 at a short distance, for example fifteen feet, from the manifold 34. The manifold 34 is also desirably made of a material, such as stainless steel, capable of operating at reduced temperatures.

Connected to each of the divergent outlets 76 is a relatively short pipe section 38 which is desirably no longer than can be carried on the trailer 66. The pipe sections 32 include male and female union connections 78, 80 and provide a valve 82 intermediate the ends thereof. The pipe sections 38 are also desirably of a material capable of operating at low temperatures.

Figure 2:
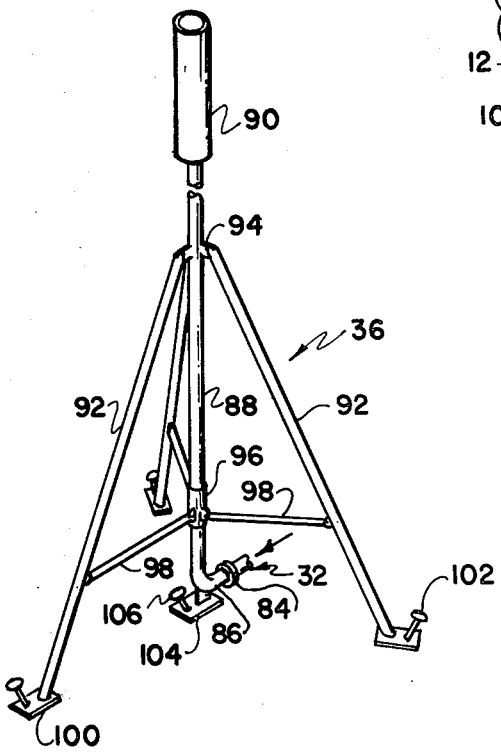
FIG. 2 is an isometric view of a flare unit utilized in the installation of FIG. 1.

As shown best in FIG. 2, the flare units 36 comprise an inlet union fitting 84 connected to the short pipe section 38. The fitting 84 is mounted on a short horizontal conduit section 86 which communicates with a long vertical conduit section 88 having a burner tip 90 on the end thereof. In order to transport the flare units 36 on the trailer 66, the units 36 are preferably collapsible or disassembleable. To this end, each flare unit 36 comprises a plurality of legs 92 pivotally mounted on an ear 94 integral with or welded to the long conduit section 88. A sleeve 96 is slideable along the conduit section 88 below the ears 94 and is connected to each of the legs 92 by a link 98 pivotally connected at opposite ends to its associated leg 92 and to the sleeve 96. The sleeve 96 is positioned on the long conduit section 88 so that the legs 92 fold into a position substantially parallel to the conduit section 88 in the collapsed position of the flare unit 36. It will accordingly be seen that the flare unit 36 can readily be collapsed for transport on the trailer 66 and set up to act as a free standing unit.

In order to immobilize the flare units 36 during operation, the legs 92 each terminate in a foot 100 having an opening therethrough. A suitable stake 102 can be driven through the opening. In a similar manner, a foot 104 is affixed to the corner between the conduit sections 86, 88 and a stake 106 driven through an opening therein.

The trailer 66 comprises an elongate frame 108 mounted for transport along an underlying surface 110 by a plurality of wheels 112. A hitch half 114 allows connection of the trailer 116 to a ball mounted on a suitable towing vehicle (not shown). A jack-up mechanism 116 is conveniently provided to level the trailer frame 108. The trailer 66 also provides a plurality of spaced racks for supporting the short pipeline sections 32, the flare units 36 and the short pipe sections 38. The thermal expansion and contraction loop 26 and the manifold 34 may be carried on the floor of the trailer frame 108. The flow control valve 42 may be welded onto the loop 26 if desired. Similarly, the throttling valve 30 may be welded onto one of the pipe sections 32 of onto the heater 28. A number of stub conduits 40 may be carried in a lock-box 120.

In use, the trailer 66 is towed to a location near the block valve 16 and the various components off-loaded and assembled in accordance with the showing in FIG. 1. The decision to incorporate the heater 28 depends, of course, on the need for it as discussed previously. When the installation 24 is assembled, the valve 42 is fully closed and the blow down valve 20 is fully opened. The throttling valve 30 is fully closed and the valve 42 is fully opened. The throttling valve 30 is cracked slightly open to allow some of the gas to be flared to pass through the installation 24 to the flare units 36. With the throttling valve 30 barely cracked open, the gas escaping from each burner tips 90 is ignited in any suitable manner, as with a burning rag wrapped on the end of a long pole as each valve 82 is opened. The valve 30 is then progressively opened to allow passage of the high pressure gas or vaporizable high pressure liquid to increase the volume of gas being delivered through the flare units 36. The valves 82 allow as many flare units 36 to be used as needed. In addition, throttling of the gas stream can also be effected by the valves 82.

As the gas passes through the throttling valve 30 and the pressure thereof is substantially decreased, the temperature of the flowing gas stream is lowered substantially below ambient. It is important under many situations to control the temperature downstream of the throttling valve 30 in order to avoid damage to the short pipeline sections 32, the manifold 34, the short pipe sections 38 and the flare units 36. One straight forward technique is to place a temperature sensor 120 downstream of the throttling valve 30. The operator can adjust the position of the throttling valve 30 to bring the temperature down to a value slightly above the crystallization temperature of the material of the short pipeline sections 32. It is desirable that the temperature be as low as possible without damaging the material of the installation 24 because this means that the flow rate through the throttling valve 30 is at a high optimum value which will decrease the time required to blow down the pipeline section 12.

Another technique for controlling the rate of flow through the throttling valve 30 is by the use of a pressure gauge 122 downstream thereof. The original pressure in the pipeline 12 is normally known or can be measured by a pressure gauge 124. Conventional tables or calculations based on the upstream and downstream pressures will enable the selection of an optimum position for the throttling valve 30.

There are many situations in which the heater 28 is desirably installed and operated in order to increase the gas temperature downstream of the throttling valve 30. One typical situation occurs when very high flow rates are desired through the installation 24 which would depress the temperature downstream of the throttling valve 30 below a value which would metallurgically change the components exposed thereto. In this sense, the term high flow rates is relative because a high flow rate that would generate temperatures sufficient to damage oil field grade pipe could be accommodated by stainless steel pipe. In other words, it might be desirable to use the heater 28 in conjunction with oil field grade pipe in order to handle similar flow rates that could be handled by stainless steel pipeline. Another situation involves the blowing down of vaporizable liquids which have relatively high heats of vaporization. Although it is preferable for the heater 28 to be upstream of the throttling valve 30 because it can be physically smaller, heating can be conducted downstream of the valve 30 if desired.

Operation of the heater 28 may be conducted in a conventional fashion.

Although the invention has been described in its preferred form with a certain degree of particularity, it is understood that the present disclosure of the preferred form is only by way of example and that numerous changes in the details of construction and the combination and arrangements of parts may be resorted to without departing from the spirit and scope of the invention as hereinafter claimed.

I claim:

1. An installation for blowing down a high pressure pipeline having a block valve for controlling flow through the pipeline and a blow down valve adjacent the block valve, comprising a first pipe section for connection to the blow down valve having an arcuate pipe segment for accomodating thermal movement of the pipe section;

a throttling valve for creating a pressure drop downstream of the throttling valve; and a manifold having a single inlet connected with the throttling valve and a plurality of outlets;

a plurality of second pipe sections connected to the plurality of outlets having a valve therein; and a plurality of flare units connected to the plurality of second pipe sections for burning the gas from the pipeline;

the pipe sections and segment being arranged to deliver all of the material from the high pressure pipeline to the flare units.

2. The installation of claim 1 including means for determining the temperature of the pipe section downstream of the throttling valve.

3. The installation of claim 2 wherein the temperature determining means includes means for measuring temperature.

4. The installation of claim 2 wherein the temperature determining means includes for determining the pressure upstream and downstream of the throttling valve.

5. The installation of claim 1 wherein the second pipe sections are of a material capable of withstanding temperatures of −75° F. without crystallizing.

6. The installation of claim 5 wherein the second pipe sections are stainless steel.

7. The installation of claim 1 further comprising a valve in the first pipe section upstream from the arcuate pipe segment.

8. An installation for blowing down a high pressure pipeline having a block valve for controlling flow through the pipeline and a blow down valve adjacent the block valve, comprising a pipe section for connection to the blow down valve having means for accommodating movement of the pipe section due to thermal expansion and contraction;

a throttling valve for creating a pressure drop downstream thereof;

means for heating material inside the pipe section; and means connected to the pipe section for burning substantially all of the material emitting therefrom.

9. The installation of claim 8 wherein the heating means is upstream of the throttling valve.

10. The installation of claim 8 wherein the heating means comprises means for combusting a first part of the material from the pipeline in heat exchange relation with a second part of the material from the pipeline.

* * * * *